US007231853B1

(12) United States Patent
Burdge

(10) Patent No.: US 7,231,853 B1
(45) Date of Patent: Jun. 19, 2007

(54) TREE STEP DRIVING TOOL

(76) Inventor: Stephen B. Burdge, RR #1, Box 207, East Waterford, PA (US) 17021

( * ) Notice: Subject to any disclaimer, the term of this patent is extended or adjusted under 35 U.S.C. 154(b) by 167 days.

(21) Appl. No.: 11/093,700

(22) Filed: Mar. 30, 2005

(51) Int. Cl.
*B25B 13/48* (2006.01)
*B25B 13/56* (2006.01)
*B25D 1/04* (2006.01)

(52) U.S. Cl. ..... 81/176.1; 7/143; 7/146; 7/147

(58) Field of Classification Search ..... 81/176.1; 7/143–147
See application file for complete search history.

(56) References Cited

U.S. PATENT DOCUMENTS 588,407 A * 8/1897 Dobson ..... 7/147
637,253 A * 11/1899 Harris ..... 254/22
693,868 A * 2/1902 Jolley ..... 81/139
1,503,323 A * 7/1924 Heasley ..... 7/144
2,437,762 A * 3/1948 Simonin ..... 81/119
3,219,316 A * 11/1965 Fried ..... 254/131
5,247,715 A * 9/1993 Nishiguchi ..... 7/138
5,624,007 A * 4/1997 Mahaffy ..... 182/92
5,743,353 A * 4/1998 Browning et al. ..... 182/92
5,806,625 A * 9/1998 Katz ..... 182/92
5,881,837 A 3/1999 Leicht ..... 182/92
5,899,124 A * 5/1999 Cross, Jr. ..... 81/176.15
D458,522 S * 6/2002 Cox ..... D8/17
6,439,343 B1 8/2002 Jorges et al. ..... 182/92
6,729,437 B1 5/2004 Apple ..... 182/92
7,017,449 B1 * 3/2006 Ritchings ..... 81/52

* cited by examiner

*Primary Examiner*—Lee D. Wilson
*Assistant Examiner*—Bryan Muller
(74) *Attorney, Agent, or Firm*—Hooker & Habib, P.C.

(57) ABSTRACT

A tree step driving tool can drive both fold-type tree steps and rod-type tree steps. The tool includes an elongate member defining a drive portion on one end of the tool and a handle portion on the other end. The drive portion is configured to be receivable within the open end of a fold-type tree step channel to drive the tree step. An opening through the member receives a rod-type tree step and enables a head attached to the drive portion to engage the rod-type tree step to drive the step.

9 Claims, 7 Drawing Sheets

TREE STEP DRIVING TOOL

FIELD OF THE INVENTION

The invention relates generally to a tool for driving tree steps into trees, and pertains particularly to a tool that can drive both fold-type and rod-type tree steps.

BACKGROUND OF THE INVENTION

Hunters and outdoor enthusiasts use tree stands when hunting or observing game or wildlife. Tree steps are used for climbing to and from the tree stand. Tree steps have a threaded screw that is driven into the tree trunk, and a step that extends from the tree trunk. A number of tree steps may be driven into the tree to provide safe access to the tree stand. When the tree stand is removed, the tree steps are also removed.

Tree steps are commonly provided as either a rod-type tree step or a fold-type tree step. A rod-type tree step is formed from steel rod and has a permanent "Z" shape. One leg of the "Z" forms the screw and the other leg forms the step.

Fold-type tree steps have the screw pivotally mounted to fold into a channel member for more compact storage. The channel member has a "U"-shaped cross section to receive the screw. A single-fold tree step has the screw pivotally mounted to an "L" shaped member that forms both the channel member and the step. A double-fold tree step has the screw and the step each pivotally mounted to a separate channel member.

Tools are available to assist in driving tree steps into or out of trees. Mahaffey, U.S. Pat. No. 5,624,007, and Cox, US Pat. D458,522 disclose tree step driving tools for driving rod-type tree steps. The tool includes a head mounted to an elongate body. The step-portion of the tree step extends through an opening in the body to locate a head against the screw and transmit torque.

Cross, Jr. U.S. Pat. No. 5,899,124 discloses a tree step driving tool that can be used to drive both rod-type and fold-type tree steps. The tool has an elongate rectangular body that receives and surrounds one end of a double-fold tree step to drive the step. Openings through the body enable the tool to receive and drive single-fold and rod-type tree steps.

Although the known tree step driving tools are useful, they each have shortcomings. The Mahaffey and Cox tools can only drive rod-type tree steps. The Cross tool can drive both rod-type and fold-type tree steps, but the rectangular body is large and so the tool is heavy and bulky.

Thus there is a need for a tree step driving tool that can drive both rod-type and fold-type tree steps but is lighter and less bulky.

SUMMARY OF THE INVENTION

The invention is a tree step driving tool that can drive fold-type tree steps and, in preferred embodiments, can also drive rod-type tree steps.

The channel member of fold-type tree steps has an open end. The tree step driving tool of the present invention extends into the open end of the channel member to drive the tree step. The tool is relatively lightweight and compact because the tool does not surround the entire channel.

In preferred embodiments the tool includes a head and at least one opening extending through the tool for driving rod-type tree steps. The head is located between the sidewalls of the channel when the tool is used for driving fold-type tree steps.

A tree step driving tool in accordance with the present invention drives fold-type tree steps of the type having an open-ended channel defined by a backwall and a pair of spaced-apart sidewalls. The tool includes an elongate first member extending between opposite first and second ends. A drive portion is located at the first end and a handle portion is located at the handle end, with a handle attached to the handle portion. The drive portion is configured to be received in the channel between the channel sidewalls for driving the step, and the handle is spaced away from the drive portion to apply torque. When the drive portion is in the channel, the drive portion drivingly engages a sidewall when torque is applied to the handle to rotate the screw portion.

In preferred embodiments a head is attached to the drive portion and at least one opening extends through the first member to receive a rod-type tree screw. The head is engagable against the tree screw to permit torque to be applied to drive the screw. Advantageously the tool is provided with a number of openings, each opening sized to closely fit a different diameter tree screw.

The head is advantageously sized to bear against a sidewall when the tool is driving a fold-type step to assist the drive portion in transmitting torque to the screw.

In other preferred embodiments a second member is spaced from and rigidly attached to the first member to define an opening between it and the drive portion. The channel backwall is received in the opening when the drive portion is inserted in the channel to resist twisting or slipping of the drive portion out of the channel. The second member can also be configured as a drive portion.

Other objects and features of the present invention will become apparent as the description proceeds, especially when taken in conjunction with the accompanying eight drawing sheets illustrating an embodiment of the invention.

DESCRIPTION OF THE PREFERRED EMBODIMENT

Figure 1:
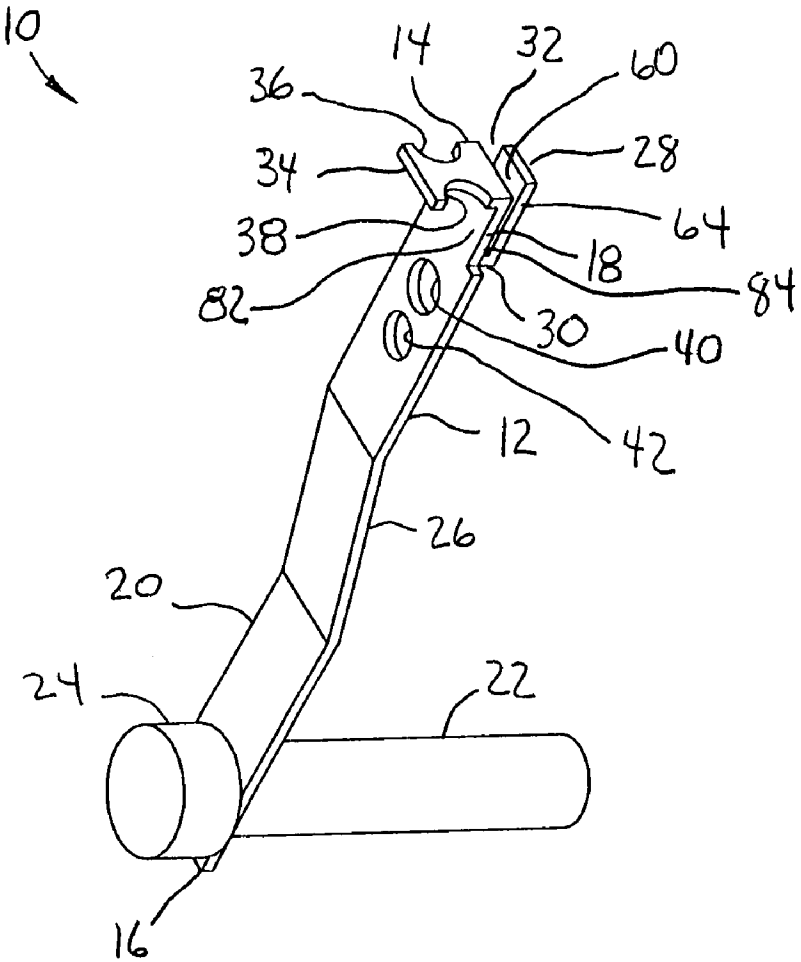
FIG. 1 is a front perspective view of a tree step driving tool in accordance with the present invention.
Figure 2:
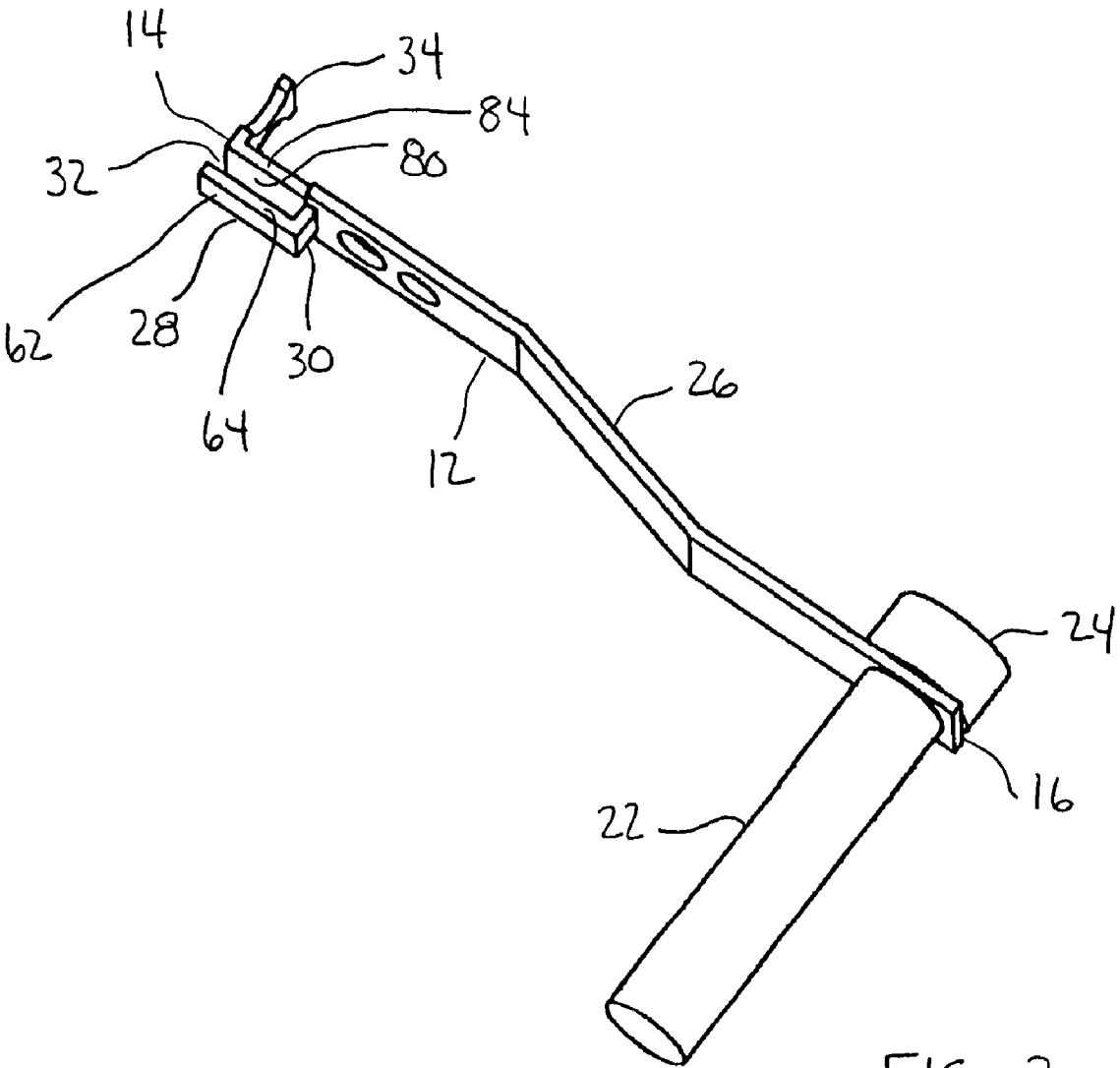
FIG. 2 is a rear perspective view of the tool shown in FIG. 1.

FIGS. 1 and 2 illustrate a tree step driving tool 10 in accordance with the present invention. Tool 10 is capable of driving both fold-type and rod-type tree steps.

Tool 10 includes an elongate first member 12 extending between opposed front and rear ends 14, 16. First member 12 is formed from flat plate and has a drive portion 18 at end 14 and a handle portion 20 at end 16. A handle 22 is attached to one side of the handle portion 20, and a resilient hammer head 24 is attached to the other side. The first member 12 has a bent portion 26 that offsets the handle portion 20 from the drive portion 18. The drive portion 18 to transmit torque from the tool to the tree step when driving double-fold tree steps as will be explained in greater detail below.

A flat second member 28 is rigidly attached to the first member 12 by plate or connecting member 30. Second member 28 is spaced from and faces the drive portion 18 to cooperatively define between them a "C"- or "U"-shaped structure having an opening 32 at the front end 14 of the tool. Second member 28 defines a second drive portion of the tool 10 to transmit torque from the tool to the tree step when driving single-fold tree steps as will be explained in greater detail below.

A third member or head 34 is attached to the drive portion 18 on the side opposite the second member 28. The head 34 has a pair of opposed concave notches 36, 38 configured to engage the screw portion of a rod-type tree screw. A pair of spaced apart bores or openings 40, 42 extend through the thickness of the first member 12 away from faces the drive portion 18 below the connecting member 30. The openings 40, 42 have different diameters and are sized to closely receive the step portion of different diameter rod-type tree steps.

The head 34 and the wall of opening 40 or opening 42 defines a third drive portion of the tool 10 to transmit torque from the tool 10 to rod-type tree steps as will be explained in greater detail below.

Figure 3:
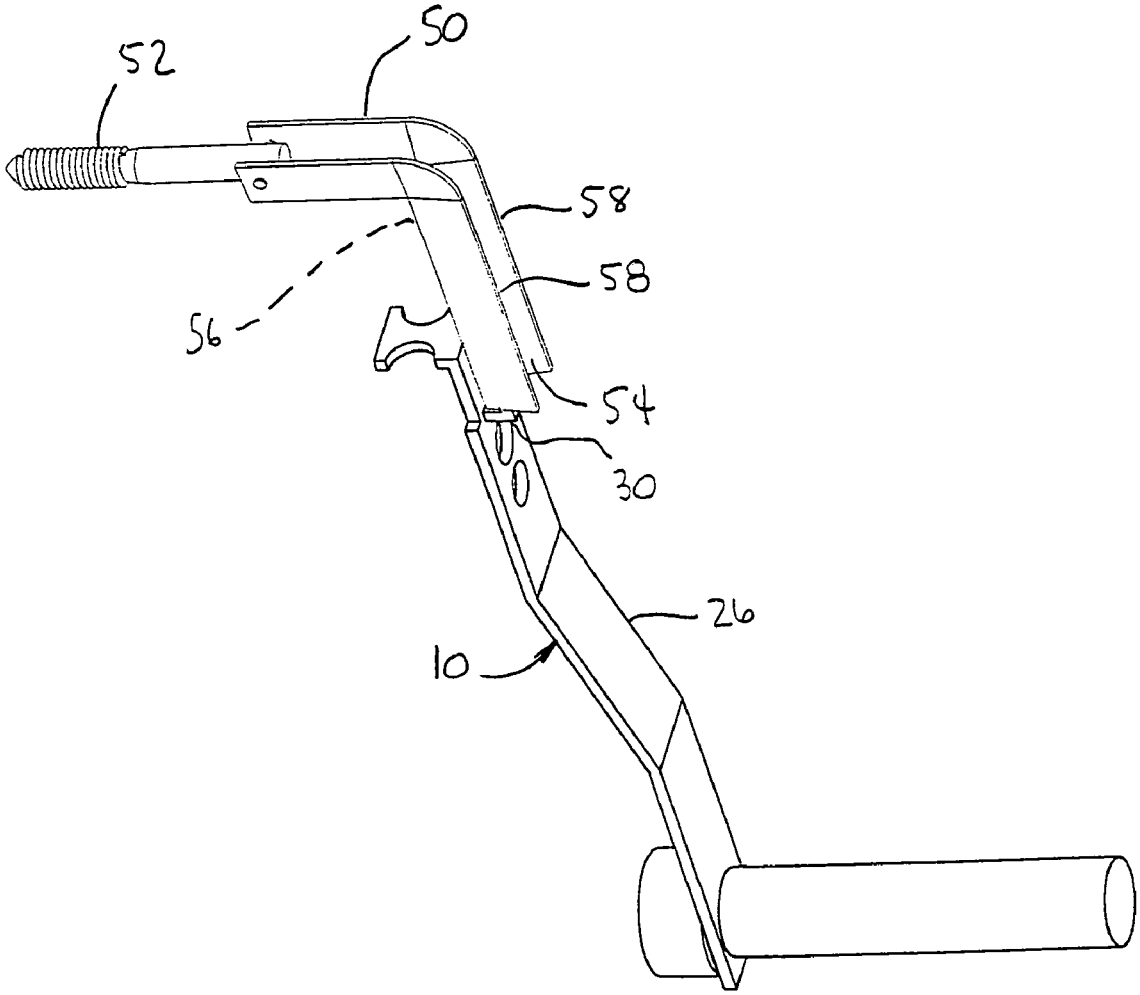
FIG. 3 is a view of the tool shown in FIG. 1 driving a single-fold tree step.

FIG. 3 illustrates the tool 10 driving a single-fold tree step 50 having a screw portion 52. Tree step 50 has an open-ended channel 54 defined by a backwall 56 and a pair of spaced-apart sidewalls 58 that extend from the backwall 56 away from the screw portion. Second member or second drive portion 28 is sized and configured to be received in the channel 54 as shown to drive the screw portion 52 into or out of a tree.

The second member 28 has a front surface 60 and an opposite rear surface 62, with opposed edges 64 joining the front and rear surfaces 60, 62 (see FIG. 1). The front surface 60 faces the backwall 56 and the edges 64 face respective sidewalls 58 when the second member 28 is in the channel 54. The bent portion 26, spaces the handle portion 20 away from the screw portion 52 and provides greater clearance from the tree when driving the screw. Applying torque to the handle 28 presses one or the other edge 64 against the adjacent sidewall 56 to transmit torque to the screw and rotate the screw portion.

The backwall 56 is received into the opening 32 when the second member 28 is inserted into the channel 54. Connection member 30 acts as a stop to limit the maximum depth of insertion of the backwall 56 into the opening. The stop is located sufficiently away from the end of the tool to permit the second member 28 to reliably drive the screw without slipping. Front surface 60 and first member drive portion 18 assist in maintaining the second member 28 in the channel 54 and resist twisting or pivoting of the tool 10 out of the plane of rotation.

Figure 4:
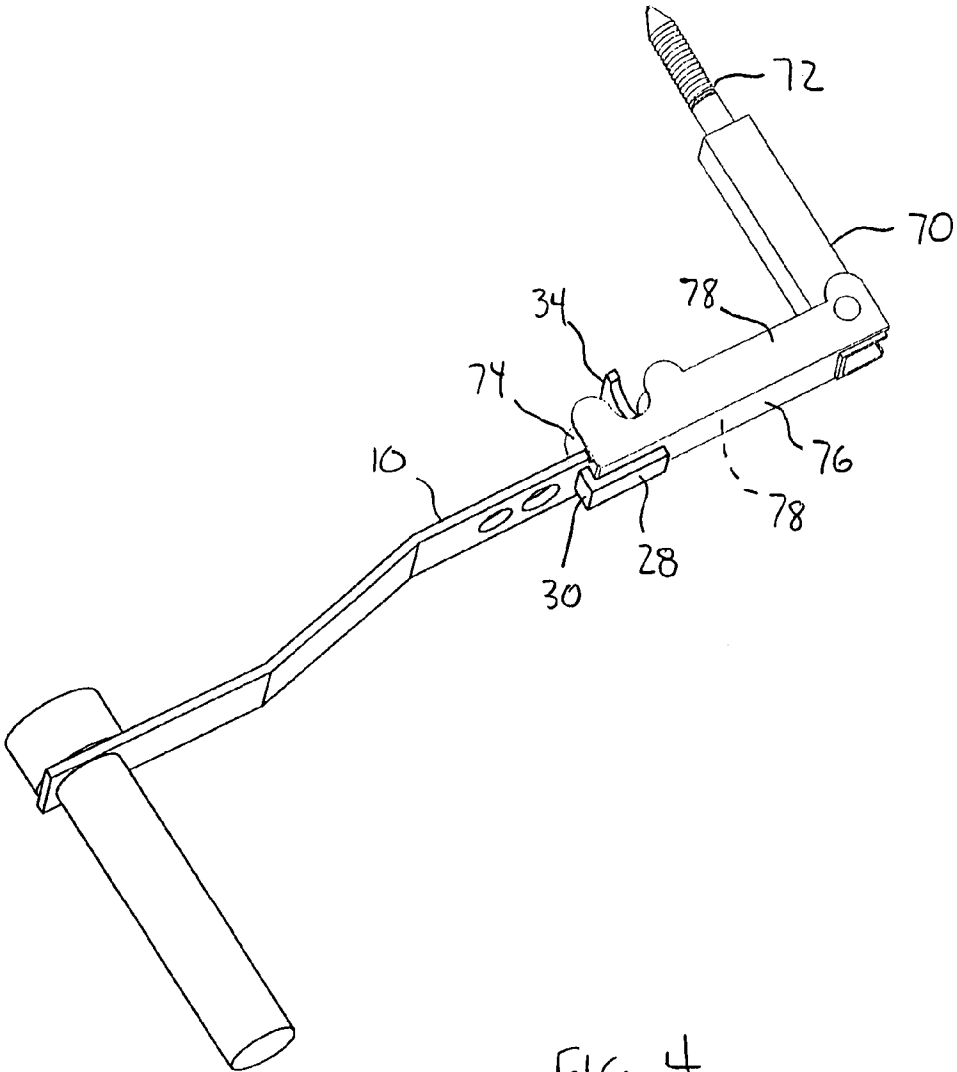
FIG. 4 is a view similar to FIG. 3 but of the tool driving a double-fold tree step, the tree step in the unfolded position.
Figure 5:
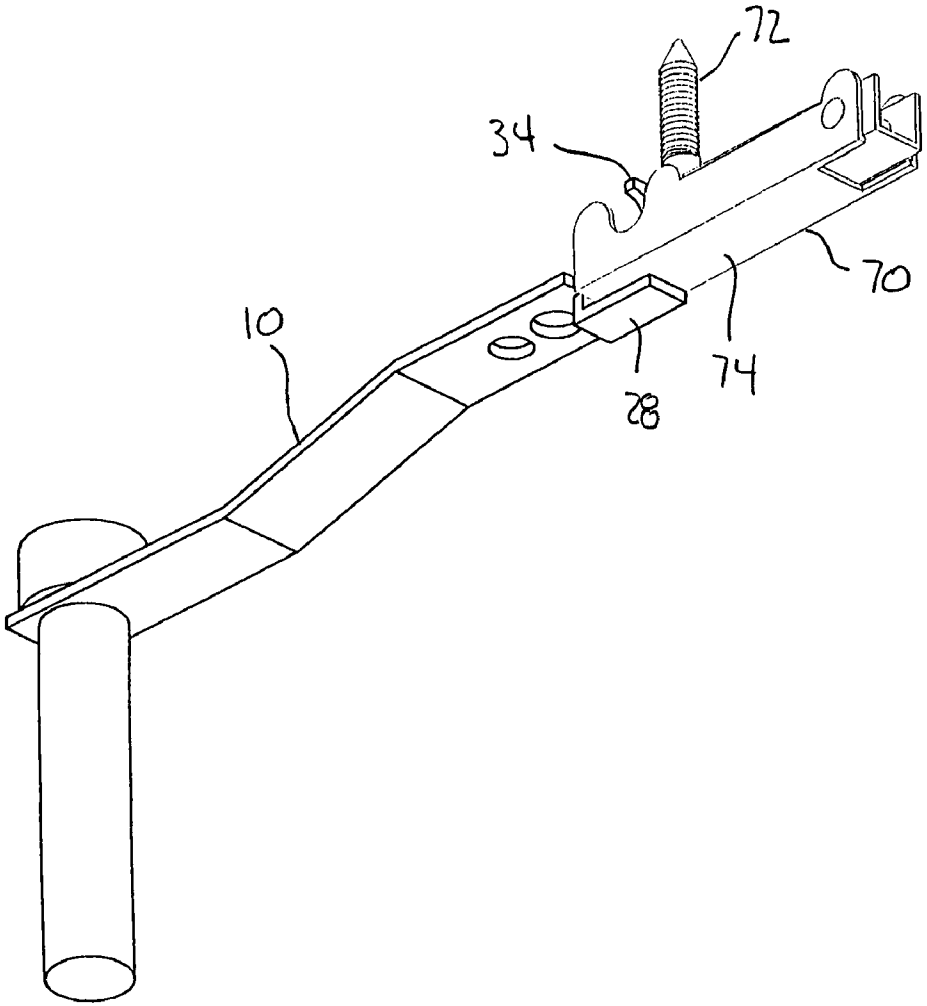
FIG. 5 is a view similar to FIG. 4 but of the tool driving the double-fold tree step in the folded position.

FIGS. 4 and 5 illustrate the tool 10 driving a double-fold tree step 70 having a screw portion 72. Tree step 70 has an open-ended channel 74 similar to but wider than channel 54. Channel 74 is defined by a backwall 76 and a pair of spaced-apart sidewalls 78 that extend toward the screw portion 72. Tool drive portion 18 is inserted in the channel 74 to drive the screw 70 in the same manner that second member 22 drove the single-fold screw 50. Backwall 76 is received in the tool opening 32 and stop member 30 sets the maximum insertion depth as described earlier.

The drive portion 18 has a front surface 80 and an opposite rear surface 82, with opposed edges 84 join the front and rear surfaces 80, 82 (see FIGS. 1 and 2). The front surface 80 faces the backwall 76 and the edges 84 face respective sidewalls 78 when the drive portion 18 is in the channel 74. The bent portion 26 spaces the handle portion 20 away from the screw portion to provide greater clearance away from the tree when driving the screw.

Applying torque to the handle 22 presses one or the other edge 84 against the adjacent sidewall 78 to transmit torque to the screw and rotate the screw. Front surface 80 and second member 28 assist in maintaining the drive portion 18 in the channel 74 and resist twisting or pivoting of the tool 10 out of the plane of rotation.

Head 34 is received between the sidewalls 78 and extends away from backwall 76. The edges of the head 34 are also engagable with the sidewalls 78 when driving the screw to provide greater bearing area to transmit torque and to help retain the tool in the channel.

FIG. 4 illustrates the tool 10 driving the tree step 70 in the step's unfolded position. The unfolded tree step 70 is similar to the single-fold tree step 60 and is similarly driven by the tool 10. FIG. 5 illustrates the tool 10 in the step's folded position. The unfolded tree step 70 provides sufficient access to the open end of the channel 74 for the tool to extend into the channel and drive the step.

Figure 6:
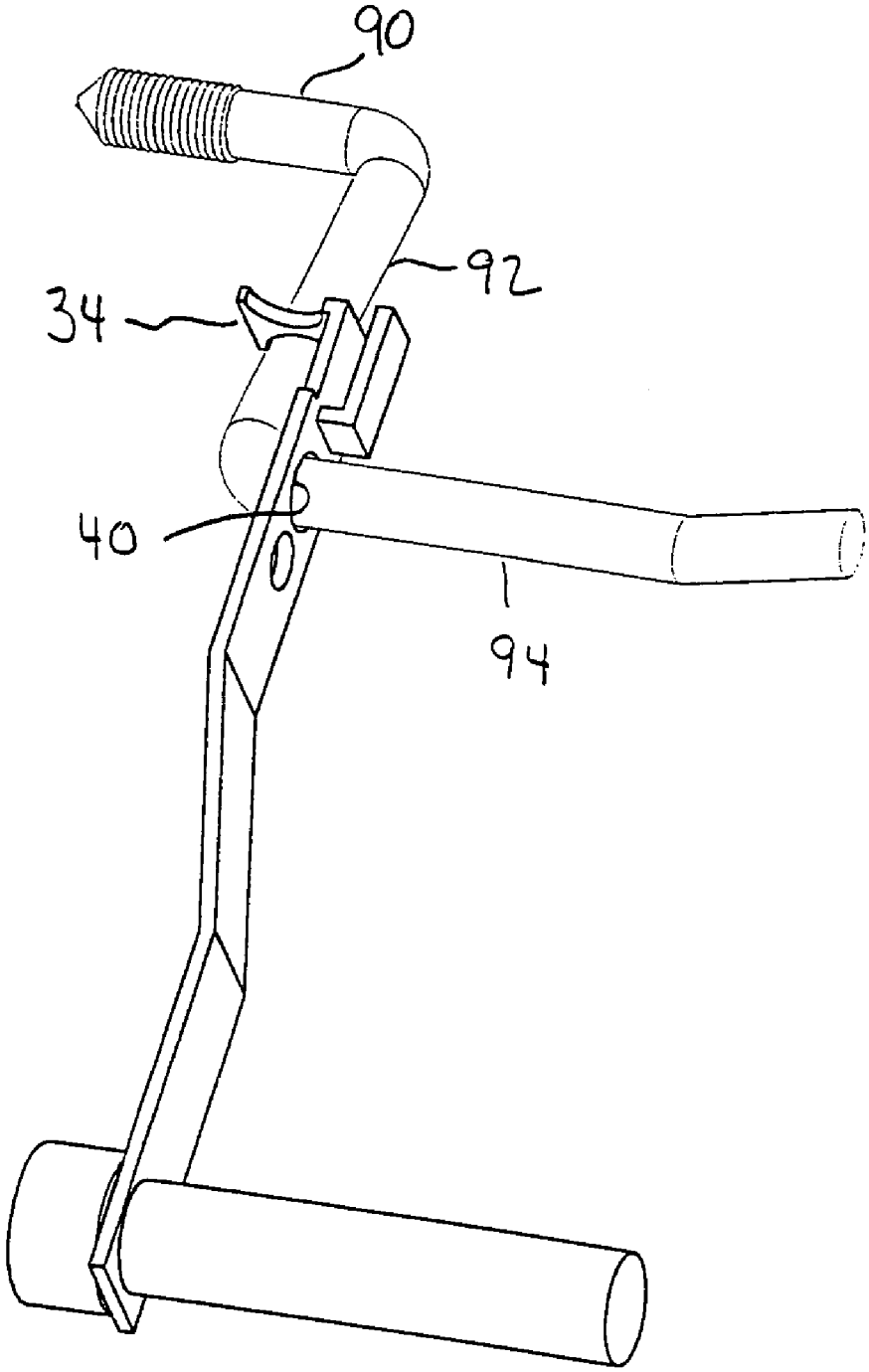
FIG. 6 is a view of the tool shown in FIG. 1 driving a first rod-type tree step.

FIG. 6 illustrates the tool 10 driving a first rod-type tree step 90 having a screw portion 92 and a step portion 94. The tree step 90 is formed from steel rod having a diameter slightly smaller than the diameter of the first tool opening 40. The step portion 94 extends through the opening 40 and one notch 36 of the tool head 34 is placed against the screw portion 92. Torque is applied to the handle 22 to press the head 36 against the screw portion 92 and the inner wall of the opening 40 against the step portion 94 to transmit torque and drive the screw.

If the direction of rotation of the screw is to be reversed, the other side of the head 34 is placed against the screw.

Figure 7:
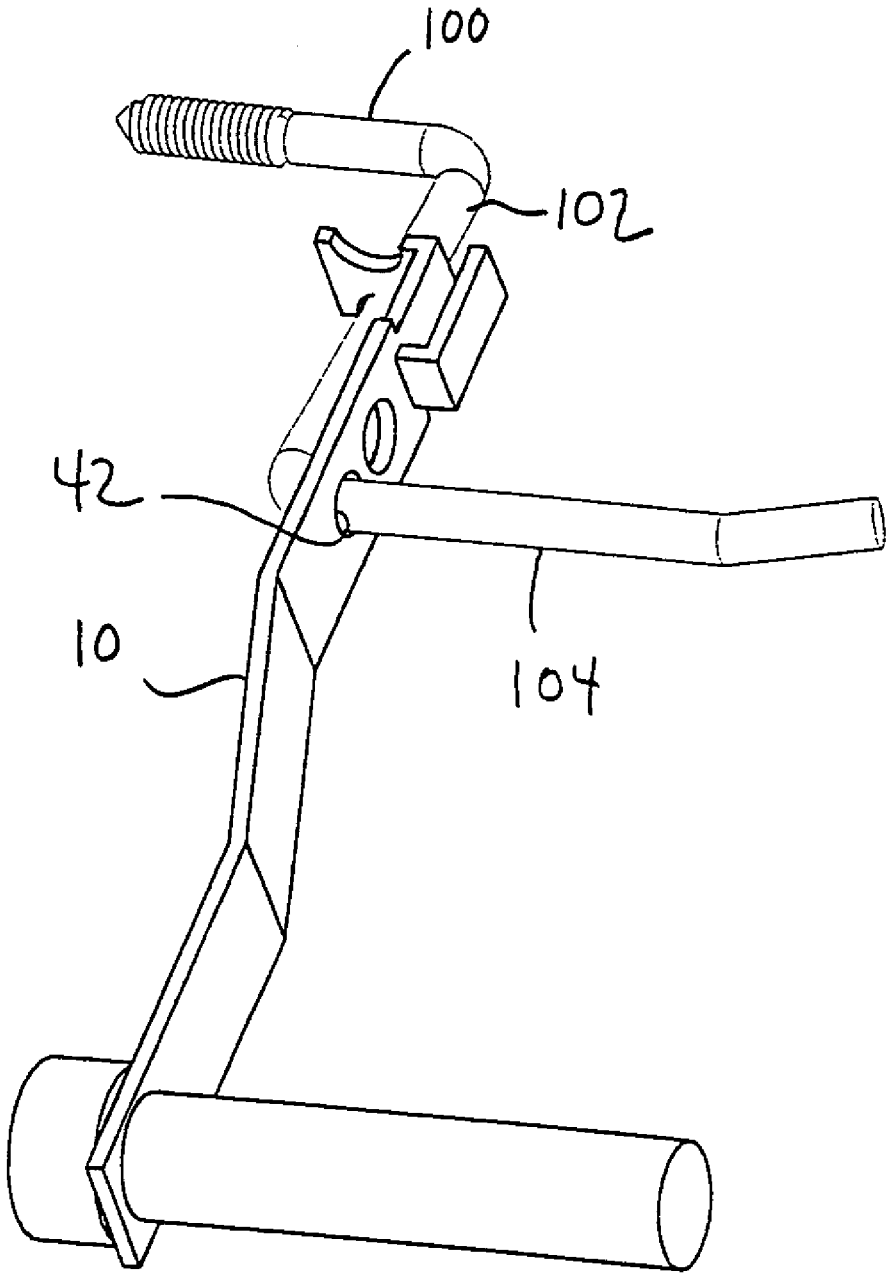
FIG. 7 is a view similar to FIG. 6 of the tool shown in FIG. 1 driving a second, reduced diameter, rod-type tree step.

FIG. 7 illustrates the tool 10 driving a second rod-type tree step 100. Tree step 100 is formed from smaller-diameter steel rod and extends through the second tool opening 42. The two different openings 40, 42 enables the appropriately sized opening to be used to receive the tree step to more efficiently drive the step. Only one opening, or more than two openings, can be provided in alternative embodiments.

The hammer head 24 is available to hammer the point of the screw thread into the tree before using the tool 10 to drive the screw.

Although it is preferred that the tool 10 be provided with a head 34 and at least one opening 40 to enable the tool to drive rod-type tree steps, these features can be omitted in embodiments intended to drive only fold-type tree steps. In such embodiments the head 34 can be retained in modified form to enable the drive portion to bear against the entire portion of the sidewall when driving multi-fold steps. Similar structure can be attached to the second member 28 in all embodiments if greater bearing area is desired.

If the tool of the present invention is intended to drive only a single style of fold-type tree steps, then only the drive portion 18 or the second member 28 need to be configured as a drive member or drive portion. Drive portion 18 would preferably be configured as the drive member if the tree step style has the channel sidewalls extending toward the screw portion. Second member 28 would preferably be configured as the drive member if the tree step style has the channel sidewalls extending away from the screw portion.

The illustrated tool 10 is made from steel, but other metals or nonmetals can be used.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. A tool capable of selectively driving either a folding tree step having a screw portion and an open-ended channel defined by a backwall and a pair of spaced-apart sidewalls or a rod tree step having a screw portion and a step portion, the tool comprising:

an elongate first member extending between opposite first and second ends, a drive portion at the first end and a handle portion at the second end, and a handle attached to the handle portion;

the drive portion configured to be received in the channel between the sidewalls of the folding tree step for driving the folding tree step with the tool;

the handle spaced away from the drive portion to apply torque when the drive portion is in the step channel, whereby the drive portion drivingly engages a sidewall when torque is applied to the handle to rotate the screw portion;

first and second openings extending through the first member to receive a respective step portion of a rod tree step, the first opening comprising a first cross section dimension corresponding to a first diameter rod tree step, the second opening comprising a second cross section dimension corresponding to a second diameter rod tree step; and a third member attached to the first member to engage the screw portion when a step portion is in the first or second opening.

2. The tool according to claim 1 comprising a second member spaced from and facing the drive portion, and a connection rigidly attaching the first and second members;

the drive portion and the second member defining an opening therebetween to receive the backwall of a folding tree step when the drive portion is in the channel of the folding tree step.

3. The tool according to claim 2, the tool for driving first and second folding tree steps, the first folding tree step having a first channel width, the second tree step having a second channel width different from the first channel width, wherein:

the first drive member is configured to drive the first folding tree step; and the second member is configured to be received in the channel between the sidewalls of the second folding tree step for driving the second folding tree step.

4. The tool according to claim 2 wherein the connection comprises a stop limiting the insertion of the backwall into the opening to a predetermined maximum depth.

5. The tool according to claim 2 wherein the drive portion and the second member each comprise a flat planar surface facing each other.

6. The tool according to claim 1 wherein the drive portion comprises a front surface, a rear surface opposite the front surface and opposed edges extending between front and rear surfaces, each edge facing a respective sidewall when the drive portion is in a folding tree step channel and engageable with the sidewall to transmit torque from the handle to the sidewall.

7. The tool according to claim 1 wherein the drive portion comprises opposite front and rear surfaces, the front surface facing the backwall when the drive portion is in the channel of a folding tree step; and the third member is attached to the rear surface of the drive portion.

8. The tool according to claim 1 wherein the third member comprises opposed edges, each edge facing a respective sidewall and engageable with the sidewall to transmit torque from the handle to the sidewall when driving a folding tree step.

9. The tool according to claim 1 comprising a resilient hammer head.

* * * * *